US009472834B2

(12) United States Patent
Werner et al.

(10) Patent No.: US 9,472,834 B2
(45) Date of Patent: Oct. 18, 2016

(54) RADIO FREQUENCY SWITCH AND PROCESSES OF SELECTIVELY REGULATING RADIO FREQUENCY ENERGY TRANSMISSION

(71) Applicants: Douglas H. Werner, State College, PA (US); Theresa S. Mayer, Port Matilda, PA (US); Peter E. Sieber, State College, PA (US)

(72) Inventors: Douglas H. Werner, State College, PA (US); Theresa S. Mayer, Port Matilda, PA (US); Peter E. Sieber, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 14/205,640

(22) Filed: Mar. 12, 2014

(65) Prior Publication Data

US 2014/0266517 A1 Sep. 18, 2014

Related U.S. Application Data

(60) Provisional application No. 61/779,130, filed on Mar. 13, 2013.

(51) Int. Cl.
*H01P 1/10* (2006.01)

(52) U.S. Cl.
CPC ..... *H01P 1/10* (2013.01)

(58) Field of Classification Search
CPC ..... H01P 1/10; H01P 1/12; H01P 1/122; H01P 1/15
USPC ..... 333/248, 258, 262
See application file for complete search history.

(56) References Cited

U.S. PATENT DOCUMENTS 3,448,302 A 6/1969 Shanefield
3,796,976 A * 3/1974 Heng et al. ..... 333/161
(Continued)

FOREIGN PATENT DOCUMENTS

WO WO-2005/031307 A2 4/2005

OTHER PUBLICATIONS

International Search Report and Written Opinion for co-pending application No. PCT/US2014/23216 dated Jun. 24, 2014.
(Continued)

*Primary Examiner* — Benny Lee
*Assistant Examiner* — Albens Dieujuste
(74) *Attorney, Agent, or Firm* — Dinsmore & Shohl LLP; Weston R. Gould

(57) ABSTRACT

Provided are radio frequency electromagnetic energy switches and processes of regulating the transmission of RF energy, that for the first time successfully employ a ChG PCM as a RF switching material. An inventive switch includes: a substrate; a first radio frequency energy conductive element on the substrate; a second radio frequency energy conductive element on the substrate; and a switch element on the substrate and connecting the first conductive element to the second conductive element, the switch element including a switching material; the switching material including a chalcogenide compound switchable between a first radio frequency electromagnetic energy conductivity value and a second radio frequency electromagnetic energy conductivity value by application of an activation energy to the switching material, such that radio frequency electromagnetic energy flowing in the first conductive element is either reflected off the switching material or transmitted through the switching material to the second conductive element.

18 Claims, 5 Drawing Sheets

(56) References Cited

U.S. PATENT DOCUMENTS

| | | | | |
|---|---|---|---|---|
| 6,882,460 | B2 | 4/2005 | Tsu et al. | |
| 6,903,362 | B2 | 6/2005 | Wyeth et al. | |
| 7,420,445 | B2 | 9/2008 | Wyeth et al. | |
| 7,646,630 | B2 | 1/2010 | Lowrey et al. | |
| 2006/0073655 | A1* | 4/2006 | Dennison ..... | H01L 27/2409 438/227 |

OTHER PUBLICATIONS

Aurelian, C., et al., "Exploiting the Semiconductor-Metal Phase Transition of VO2 Materials: a Novel Direction towards Tuneable Devices and Systems for RE-Microwave Applications," Advanced Microwave and Millimeeter Wave Technologies Semiconductor Devices Circuits and Systems, Moumita Mukherjee (Ed.), ISBN: 978-953-307-031-5, InTech (2010).

Chua, E.K. et al., "Low resistance, high dynamic range reconfigurable phase change switch for radio frequency applications," Applied Physics Letters 97, 183506 (2010).

Hummel, G., "Characterization of Phase Change Materials for Radio Frequency Applications," Electronics, 2012 NNN Rev Research Accomplishments, pp. 62-63 (2012).

Grant, P.D. et al., "A Comparison Between RF MEMS Switches and Semiconductor Switches," Proceedings of the 2004 International Conference on MEMS, NANO and Smart Systems (ICMENS'04)-7695-2189-4/04, IEEE (2004).

Hudgens, S., et al., "Overview of Phase-Change Chalcogenide Nonvolatile Memory Technology," MRS Bulletin, pp. 829-832 (Nov. 2004).

Newman, Harvey S., "Lifetime Measurements on a High-Reliability RF-MEMS Contact Switch," IEEE Microwave and Wireless Components Letters, vol. 18, No. 2, pp. 100-102, Feb. 2008.

Rebeiz, Gabriel M. et al., "RF MEMS Switches and Switch Circuits," IEEE Microwave Magazine, pp. 59-71, Dec. 2001.

Stefanini, Romain et al., "Miniature MEMS Switches for RF Applications," Journal of Microelectromechanical Systems, vol. 20, No. 6, pp. 1324-1335, Dec. 2011.

* cited by examiner

RADIO FREQUENCY SWITCH AND PROCESSES OF SELECTIVELY REGULATING RADIO FREQUENCY ENERGY TRANSMISSION

CROSS REFERENCE TO RELATED APPLICATIONS

This patent application claims priority from U.S. provisional patent application Ser. No. 61/779,130, filed Mar. 13, 2013, the entire content of which is incorporated herein in its entirety.

FIELD OF THE INVENTION

The invention relates to switches for use in electronic devices and systems. More specifically, the invention relates to radio frequency switches and materials used in such switches.

BACKGROUND OF THE INVENTION

Radio frequency (RF) switches play a key role in countless electronic devices that are critical to a wide range of technologies including communications and radar systems, medical instrumentation, and consumer electronics. Switching technologies used in these systems historically involve mechanical on/off switches, and transistor or transistor-like semiconductor switching devices. For these typical switching choices trade-offs must be made among static power consumption, switch isolation, insertion loss, switching speed, required voltage bias, power handling, cost, and reliability.

Transistor and transistor-like semiconductor switching devices such as PIN diodes and varactors are commonly employed in circuits designed to interact with electromagnetic waves. PIN diodes have a superior on-off ratio and switching capability for the majority of applications when compared to varactors. However, PIN diodes require biasing and in turn much larger DC power consumption, which makes them unattractive for systems that require a significant number of switches, such as phased array antennas.

The functional process of mechanical on/off switches, such as RF MEMS switches, involves the physical motion of a conductor between two positions such that to close a circuit a physical bridge contacts two conductors and completes the conducting path of the circuit. To move the circuit into an open configuration, the bridge must be moved away from one contact to break the circuit path. While many improvements have been made in modern RF MEMS switches, the tradeoff between power handling capability and reliability is poor. RF MEMS have shown to be reliable for cold-switched and very low-power applications ($>10^9$ cycles). When hot switching is required in combination with moderate power levels, e.g. 0.1 Watts, reliability drops significantly such that RF MEMS devices are not a viable option. Also, RF MEMS switches significantly outperform PIN diodes and varactors in terms of their on-off ratio and distortion, but have many drawbacks including higher cost, lower power handling, and, for many applications, lower reliability (switching cycles before failure) due to their mechanical nature.

Each of the currently employed switches, e.g. RF MEMS and more prevalent semiconductor based devices such as PIN diodes and varactors, have significant drawbacks. Thus, any new switching technology that can improve on the currently required trade-offs will make an important impact on RF design. Despite this importance and hundreds of millions of dollars of research, there remains a need for improved switches in the RF regime.

SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole. It is appreciated that the individual elements of the following text and claims are intermixable or combinable in all ways.

One object of the invention is to provide a rapid, reversible, and robust switch for use in the regulation of the transmission of radio frequency electromagnetic energy. The provided switches and methods accomplish this goal using chalcogenide phase change materials that have the ability to reversibly regulate the transmission of RF energy.

An inventive switch is provided that includes a substrate, a first radio frequency energy conductive element on the substrate, a second radio frequency energy conductive element on the substrate, and a switch element on the substrate, the switch connecting the first conductive element to the second conductive element, the switch comprising a switching material, the switching material comprising a chalcogenide compound switchable between a first radio frequency electromagnetic energy conductivity value and a second radio frequency electromagnetic energy conductivity value by application of an activation energy to the switching material, such that radio frequency electromagnetic energy flowing in the first conductive element is either reflected off the switch or transmitted through the switch to the second conductive element.

The switching of the switch material is altered from a transmissive to a non-transmissive state via application of an activation energy. An activation energy is optionally heat, electromagnetic energy, electrical energy, a Newton force, thermodynamic energy transfer, nuclear force, or combinations thereof.

A switching material is a ChG material suitable for regulating the transmission of RF energy therethrough. Optionally, a said switching material comprises Se, Te, or combinations thereof. Optionally, the switching material comprises Ge, Sb, Se, In, Ag, Sn, S, or combinations thereof. In some particular embodiments, a switching material comprises GeSbTe, optionally in a ratio of $Ge_2Sb_2Te_5$. A switching material has multiple electromagnetic energy conductivity values depending on the phase the material is in. Optionally, a second radio frequency electromagnetic energy conductivity value is higher than a first radio frequency electromagnetic energy conductivity value, or vice versa.

A switch is optionally assembled on or includes a substrate. A substrate optionally includes quartz, a polymeric material, or silicon.

The switch regulates the transmission of RF energy from a first radio frequency energy conductive element to a second radio frequency energy conductive element. A first radio frequency energy conductive element, a second radio frequency energy conductive element, or both is optionally a waveguide suitable for transmission of radio frequency electromagnetic energy. The RF energy is optionally in a band selected from the group consisting of TLF, ELF, SLF, ULF, VLF, LF, MF, HF, VHF, UHF, SHF, EHF, THF, and combinations thereof.

Also provided are methods of regulating the transmission of radio frequency electromagnetic energy through a switch regulated transmission pathway including providing a chalcogenide switching material positioned in a radio frequency electromagnetic energy transmission pathway, applying an activation energy to said switching material, producing a phase change in said switching material from a first phase to a second phase imparted by said activation energy, said step of producing altering the transmissibility of said switching material to said radio frequency electromagnetic energy from a first radio frequency electromagnetic energy conductivity value to a second radio frequency electromagnetic energy conductivity value. The method optionally uses a switch of any embodiment described above using any combination of elements. The RF energy is optionally in the band selected from the group consisting of TLF, ELF, SLF, ULF, VLF, LF, MF, HF, VHF, UHF, SHF, EHF, THF, and combinations thereof. An activation energy is optionally heat, electromagnetic energy, electrical energy, pressure, conformational stress, high energy particles, or combinations thereof.

The provided switches and processes fulfill a long unmet need for effective regulation of RF energy transmission.

DETAILED DESCRIPTION OF EMBODIMENTS OF THE INVENTION

Figure 1:
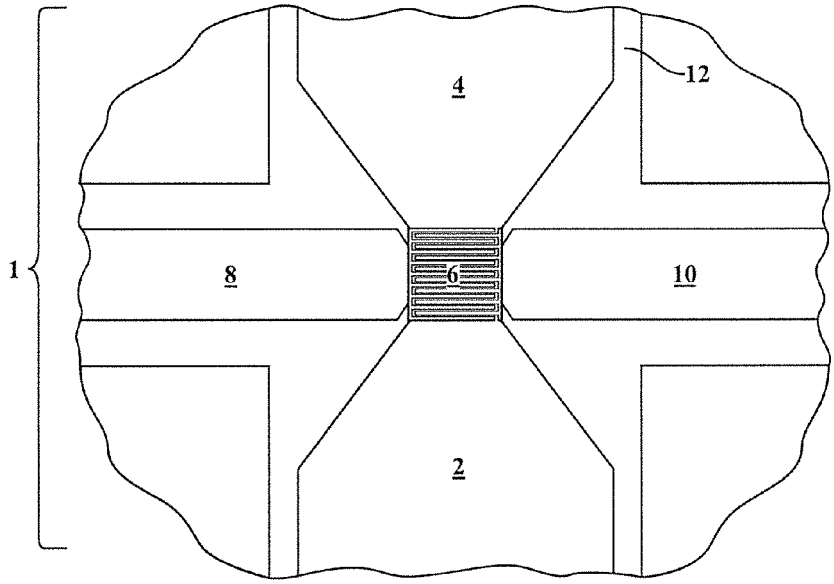
FIG. 1 is an illustration of an RF energy switch according to one embodiment of the invention.

The following description of particular embodiment(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the processes or compositions are described as an order of individual steps or using specific materials, it is appreciated that steps or materials may be interchangeable such that the description of the invention may include multiple parts or steps arranged in many ways as is readily appreciated by one of ordinary skill in the art.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, "a first element," "component," "region," "layer," or "section" discussed below could be termed a second (or other) element, component, region, layer, or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

A chalcogenide (ChG) phase change material based radio frequency energy based switch and processes of the use of chalcogenide phase change materials (PCM) are provided. The invention has utility as an apparatus and processes for regulating transmission of radio frequency (RF) energy.

The switches and processes provided use ChG PCMs in a RF switch that has a number of advantages over current RF switching technologies. In particular, the ChG PCM switches of the present invention require zero static power consumption (nonvolatile) and are capable of achieving greater reliability as well as higher yield and lower cost than RF MEMS. Additionally, a ChG PCM switch will handle greater power than current RF MEMS technologies. Due to the steady phase state nature of ChG PCM switches, they eliminate the need for the biasing voltage/current that all other current technologies require, which can lead to significant power savings. Furthermore, RF MEMS, the most heavily researched RF switching technology over the past decade, are presently a relatively expensive technology as it requires hermetic packing as well as a very high bias voltage, which requires expensive drive components. The technology's cost is further increased by the fact that manufacturing yields are still low. The inventive ChG PCM switches solve these problems and provide a relatively low cost solution to regulating RF energy transmission.

A key figure of merit (FOM) for all RF switches is the ratio of the on-state ($Z_{on}$) to off-state ($Z_{off}$) impedances. These metrics are degraded by increasing the on-state resistance (R) and/or the off-state capacitance (C) as a function of angular frequency (ω). Specifically, the FOM is defined as:

$$FOM = \frac{Z_{on}}{Z_{off}} = j\omega CR \quad \text{(I)}$$

Based on this FOM, compared to semiconductor and MEMS devices, the inventive RF switches and processes employ a ChG PCM that is particularly advantageous over current technologies due to a low on-state resistance and off state capacitance. The superior FOM entails a very large bandwidth low insertion loss, and extremely large on/off ratio. The superior FOM is also combined with high reliability, non-volatility and low power consumption, all equating to a superior RF switch. Additionally, the inventive ChG PCM switches achieve much greater yield, reliability, and power handling performance than current RF MEMS technology.

Provided are radio frequency electromagnetic energy switches that for the first time successfully employ a ChG PCM as a RF switching material. The switches are the first to explore and confirm ChG PCMs as a viable switching material for the RF regime. An inventive switch includes: a substrate; a first radio frequency energy conductive element on the substrate; a second radio frequency energy conductive element on the substrate; and a switch element on the substrate and connecting the first conductive element to the second conductive element, the switch element including a switching material; the switching material including a chalcogenide compound switchable between a first radio frequency electromagnetic energy conductivity value and a second radio frequency electromagnetic energy conductivity value by application of an activation energy to the switching material, such that radio frequency electromagnetic energy flowing in the first conductive element is either reflected off the switching material or transmitted through the switching material to the second conductive element.

A switch is a radio frequency (RF) energy transmission switch. The switch has the capability of reversibly switching from a transmissive phase to a resistive phase and to reverse itself. A switch is capable of converting between the two phases rapidly and repeatedly for an indefinite number of phase changes. The RF energy transmitted by the switch is optionally electromagnetic energy of a wavelength from 8 μm to $10^5$ km and having a frequency of 3 Hz to 37.5 THz or any value or range there between. Optionally, The RF energy transmitted by the switch is optionally electromagnetic energy of a wavelength from 0.1 mm to $10^5$ km and having a frequency of 3000 GHz to 3 Hz. Optionally, RF energy transmission has a frequency of 3 kHz to 37.5 THz. Optionally, RF energy transmission has a frequency of 1 GHz to 37.5 THz. In some embodiments, the switches are not used or are not capable of switching in the infrared wavelengths as the way a ChG PCM interacts with RF energy is fundamentally different due the small size of the switching material required and increased metallic losses. This is due to a number of factors including the inability to effectively switch back and for the between transmissive phase and resistive phase repeatedly for ChG PCM based switches in with dimensions operable in the IR wavelengths. In the crystalline state, GST at IR band and above behaves as a low loss dielectric vs. a lossy dielectric in its respective phase states. In contrast, the invention functions in a resistive manner. As a dielectric, the ChG switch material cannot transmit a signal but rather is used to shift resonance positions. The application for such a design is limited to absorbers. At IR, many methods of switching the ChG are not physically realizable due to the structure's nm scale (size is governed by the operating frequency). IR based switches are restricted to dimensions in the nm range with upper limits being less than 10 μm, and in reality 1 μm or less with operational (i.e. non-experimental) systems actually having dimensions of 100 nm or less. Due to the required scale of the switching structure at IR methods available at RF are not applicable due to fundamental physical limits. In order to switch back and forth between phase states heat must be rapidly applied and removed. The best method to induce heat rapidly is to utilize abrupt localized heating via pulsed energy. For non-local heating such as that required for IR methods, the ChG cannot be turned back and forth between phase states-specifically; it can only be changed from amorphous to crystalline but not back to amorphous from the crystalline state due to an inability to rapidly remove heat for the desired crystalline to amorphous transition. These limitations do not apply to ChG at RF frequencies since properly scaled heating methods are physically realizable. As is described herein, the invention for the first time is capable of demonstrating excellent RF switching that is not appreciated or thought possible from prior attempts with IR.

An RF energy switch uses a ChG PCM as a switch material. Illustrative examples of a ChG PCM include those that combine the elements Te, Se, or combinations thereof with one or more second elements. A second element is optionally more electropositive than the Te or Se. A second element is optionally Ge, Sb, Se, In, Ag, Sn, S, or combinations thereof. A ChG PCM optionally includes Ge Sb and Te. Illustrative non-limiting examples of a ChG PCM include GeTe, $Ge_1Sb_2Te_4$, $Ge_2Sb_2Te_5$, $Ge_4Sb_1Te_5$, $In_3SbTe_2$, $AgSbTe_2$, $AuSbTe_2$, $Au_{25}Ge_4Sn_{11}Te_{60}$, $Ag_3In_4Sb_{76}Te_{17}$, and $Ag_{5.5}In_{6.5}Sb_{59}Te_{29}$. While much of the present description is directed to $Ge_2Sb_2Te_5$ (GST), it is appreciated that many embodiments supplement or substitute other ChG PCMs. As $Ge_2Sb_2Te_5$ is demonstrated to be an excellent switching material and its use as an RF switching material produces excellent characteristics, $Ge_2Sb_2Te_5$ in some embodiments is optionally used as an exclusive switching material to the exclusion of all other ChG PCMs.

ChG PCMs used in the provided switches and processes have two stable phase states (amorphous and crystalline) that exhibit RF frequency conductivities three to five orders of magnitude higher in the crystalline state relative to the amorphous state. When the ChG PCM is in its amorphous state, it becomes highly insulating to RF energy allowing very little electromagnetic energy to pass, thus behaving as an open switch. Conversely, in the crystalline state ChG PCMs have a high conductivity, behaving as a closed switch. This differs from prior attempts using ChG as a material to regulate IR energy. In such prior attempts, the ChG is useful only to move the IR energy interaction to a slightly different resonance position thereby limiting the useful applications to absorbers. In contrast, the present RF energies may be rapidly and repeatedly "switched" from being conducted through the switch material to effectively blocked from such transmission. A similar resistance change to RF energy can be observed in a non-ChG PCM, namely Vanadium (IV) oxide ($VO_2$). Yet, $VO_2$ suffers from a low transition temperature (68° C.) which makes it incompatible with many applications where ambient temperatures can easily surpass this temperature. Additionally, $VO_2$ is volatile, requiring static energy to maintain the switch in the conducting state. Ideally a bistable, nonvolatile PCM with a higher transition temperature can be used. ChG PCMs are both compatible with many applications and have a sufficiently high transition temperature such that they can be used in applications that function in relatively high ambient temperatures. As such, the switches and processes of the invention do optionally do not include $VO_2$.

The phase change of a ChG PCM provides for switching between greater or lower conductivity to radio frequency electromagnetic energies. Thus, a second radio frequency electromagnetic energy conductivity value is optionally higher or lower than a first radio frequency electromagnetic energy conductivity value. Illustratively, an amorphous $Ge_2Sb_2Te_5$ has a conductivity to RF energy of approximately 100 S/m, or a resistivity of $1\times10^{-2}$ Ω-m. When the GST is in the crystalline state its response resembles a simulated response with a conductivity of approximately 100 kS/m, or a resistivity of $1\times10^{-5}$ Ω-m, a change of three orders of magnitude. Thus, a second radio frequency electromagnetic energy conductivity value is optionally higher by 1, 2, 3, 4, of 5 orders of magnitude relative to a first radio frequency electromagnetic energy conductivity value.

A switch material is used in a switch at a set of dimensions suitable for conducting RF energy. Illustratively a switch material has a length (L), a width (W) and a thickness (T). L is optionally from 20 nm to 500 μm, optionally from 2 μm to 500 μm, optionally from 11 μm to 500 μm. W is optionally from 20 nm to any necessary dimension to conduct the amount of RF energy desired. T is optionally from 10 nm to 1000 nm, optionally from 100 nm to 500 nm, optionally, from 200 nm to 300 nm, optionally 250 nm. A switch material also has a transmission length (TL) which is defined as the distance from a first conducting element to a second conducting element whereby RF energy is transmitted through the switching material or prevented from such transmission. A TL is optionally in excess of 10 μm. A TL is optionally from 1 μm to 200 μm, optionally from 20 μm to 100 optionally from 40 μm to 60 μm, optionally 50 μm.

A switch material electromagnetically connects two or more conductive elements. A conductive element is capable of transmitting RF energy through the conductive element. In some embodiments, a first conductive element and a second conductive element are discontinuous. A first conductive element and a second conductive element are arranged such that they may form a radio frequency electromagnetic energy transmission pathway that includes a switching material within the pathway. RF energy may flow with low resistance from a first conductive element to a second conductive element when a switch material is in a transmissive phase. Optionally, no material is present between a first conductive element and a second conductive element other than a switch material. As such, in some embodiments the signal path is free of any material other than the switch material. Such a configuration reduces insertion loss that would otherwise be present. The suitable ChG PCM of the invention optionally has a resistance of 1 ohm or less and typically 0.1 or 0.01 ohms or less.

A switch optionally includes a substrate. A substrate is a material used to support a switching material, one or more conductive elements, or combinations thereof. A substrate is optionally insulating. A substrate is optionally glass such as borosilicate glass, quartz, a polymeric material (e.g. polyimide, PEEK, polyethylene, or transparent conductive polyester), a semiconductor material such as silicon or other material, or other material known in the art for switch devices. Optionally, a substrate contacts only a portion of or none of an RF transmission line defined as a first RF energy conducting element, a second RF energy conductive element and a switch. Illustrative examples of a substrate contacting only a portion of an RF transmission line include air-bridge topologies/inert gas. Such a configuration is advantageous for decreasing the capacitance.

Some embodiments of an RF switch is a four-terminal device where two terminals represent the conducting elements for RF switching, and the other two terminals are used for electrical, optical, Newton forces (i.e. pressure, stress), thermodynamic energy transfer, nuclear forces, or other control to provide an activation energy to open or close the switch. Optionally, a three terminal switch device is used whereby two terminals are for RF switching and the other terminal is a control to provide activation energy. Optionally a two terminal switch device is used. Particular applicability of a ChG PCM switch is as a four terminal device (two ports for RF switching and two ports for electrical control) designed to function at the microwave communication bands (e.g., the C, I, K, Ka, Ku, L, M, Q, S, U, V, W and X bands). A switch and process optionally are not used for regulating conduction of electromagnetic energies outside the RF range. A switch is optionally created by placing a section of ChG PCM in energy contact with two activation energy conductors (e.g. metallic electrodes) and changing the phase state via thermo-electrical or optical switching and conducting RF energy across the switching material.

A ChG PCM switching material has many advantages including that the material is bi-stable meaning that it remains (with no application of signal or energy required) in the last state into which it was switched until the next application of activation energy of sufficient magnitude is applied. Thus, application of an activation energy need only be applied to induce the ChG PCM to change phase from its current phase to the opposite phase (i.e. crystalline to amorphous, or amorphous to crystalline). An activation energy is optionally heat, electromagnetic energy, electrical energy, Newton forces (i.e. pressure, stress), thermodynamic energy transfer, nuclear forces, or combinations thereof. An activation energy is optionally applied by a heat pulse, an optical pulse, an electrical pulse, pressure pulse, high energy particle pulse, or combinations thereof, among others that will induce a phase change in a ChG PCM. Methods and systems for creating a heat pulse, an optical pulse, of an electrical pulse are known in the art. Optionally, a thermoelectric heating element(s) is used to induce phase change. Suitable thermoelectric heating elements and materials to produce them are recognized in the art. Optionally, an activation energy is not heat.

An activation energy is optionally heat. The ChG PCM is optionally heated to an activation temperature of 40° C. to 220° C., or any value or range there between. An activation temperature is optionally from 140° C. to 160° C. An activation temperature is optionally from 190° C. to 210° C. Various ChG PCMB may be tailored to adjust the phase transition temperature for various applications. For example GST materials currently undergo a phase transition near 150° C. The phase transition temperature of a ChG PCM could be adjusted up or down by the addition of additives, dopants, or alloy materials. The ratio of the glass transition temperature to the melting temperature is also an important ratio for defining the operation characteristics of the inventive switch. This ratio is termed the reduced glass-transition temperature $T_{rg}=(T_g/T_m)$. The lower the value of $T_{rg}$ the faster the material switches. Thus, the ChG PCM is optionally tailored to the required efficiency, ambient temperature and switching speed required for the particular application.

A switch can be alternated between a resistive phase and a transmissive phase or from a transmissive phase to a resistive phase in a switching time. A switching time is optionally less than 10 seconds, optionally, less than 1 second, optionally less than 100 μs, optionally less than 1 μs, optionally 1-100 ns.

As an exemplary embodiment, FIG. 1 shows a four terminal switch 1 with a thermally coupled (but electrically isolated) electrical heater imbedded into a ChG PCM based switch material. A pair of activation energy terminals 2, 4 are located on opposite sides of the ChG PCM based switch material 6 and an activation energy element (e.g. resistor) (not shown) controlled by the heater terminals is positioned below the ChG PCM in electrical contact with the activation energy terminals. The activation energy element is in direct or indirect contact with the switch material 6 so as to transfer activation energy from the activation energy element to the switch material. In the device of FIG. 1, the activation energy terminals are heater terminals that drive a resistor positioned below the switch material. Application of a current to the heater terminals 2, 4 increases the temperature of the heater element to provide an activation energy and thereby produce a phase change in the ChG PCM switch material 6. The ChG PCM is flanked on opposite sides by two RF terminals (radio frequency energy conductive elements 8, 10) formed from coplanar waveguide transmission lines and electromagnetically linked together via the intermediate switch material. The activation energy terminals 2, 4, the radio frequency energy conductive elements 8, 10, and the switch material 6 are all assembled on a quartz substrate 12. The application of the activation energy in the form of heat (as one example) causes a phase change in the ChG PCM allowing RF energy to move across the ChG PCM from a first conductive element to a second conductive element, or be reflected back into the first conductive element depending on whether the ChG PCM is in the crystalline or amorphous phase, respectively.

Figure 2:
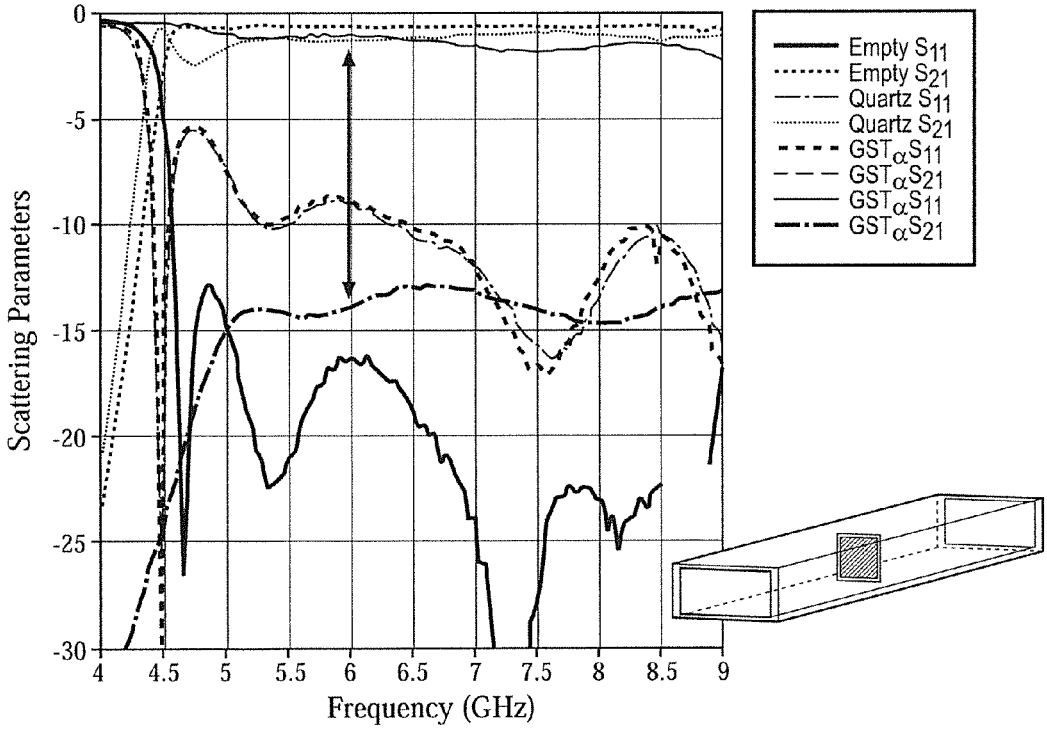
FIG. 2 illustrates the large broad band conductivity change exhibited by some embodiments of RF switches according to the invention.

To demonstrate the conductivity of each ChG PCM phase in a particular exemplary embodiment, a 300 nm layer of a particular ChG PCM, $Ge_2Sb_2Te_5$ (GST), was deposited on a quartz slide in the configuration of the switch of FIG. 1. The slide was placed inside a waveguide and transmission of RF energy was measured in the amorphous and crystalline states of the GST. Referencing FIG. 2, it is clear that a large, broadband conductivity contrast exists between the amorphous and crystalline states as the wave scattering incident on the test cell goes from transmission to reflection as the test cell is set and reset between the amorphous and crystalline states by toggling the activation energy element to an on state to cause a phase change in the switch material.

Figure 3A:
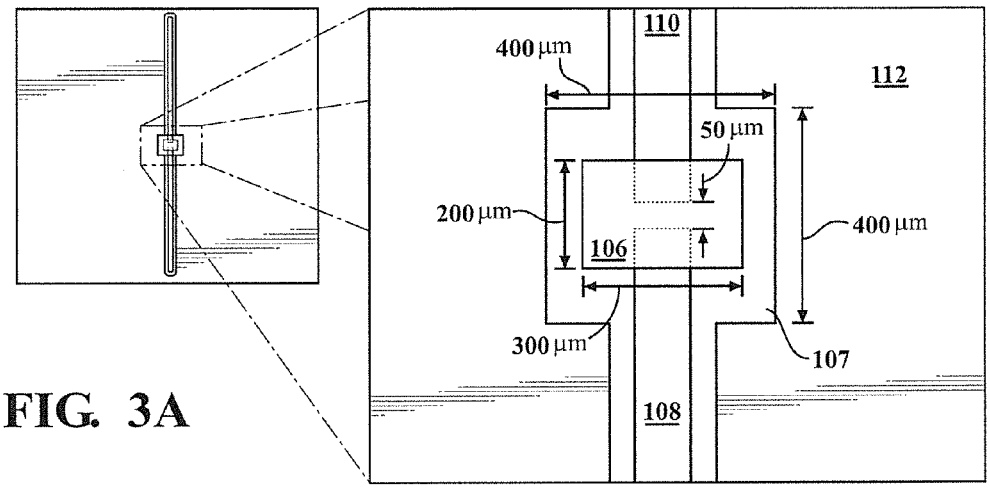
FIG. 3A illustrates an RF energy switch according to one embodiment of the invention.
Figure 3B:
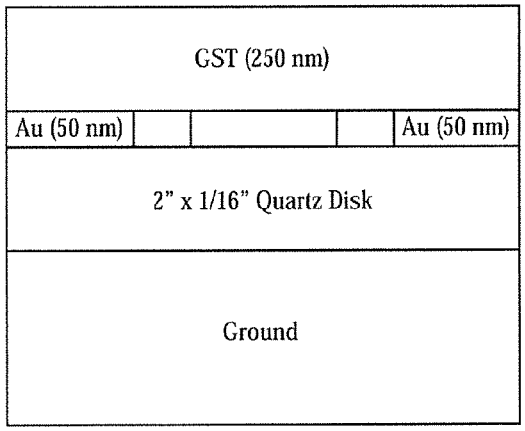
FIG. 3B illustrates a cross sectional illustration of an RF energy switch of FIG. 3A.

In another exemplary embodiment shown in FIGS. 3A-3B, a section of GST based switch material 106 was deposited on a set of coplanar waveguide (CPW) transmission line (TL) based test structures serving as conductive elements 108, 110. The elements are disposed on a quartz slide as a substrate 112. The switch material 106 is placed upon an activation element 107 to produce a phase change in the switch material. For the GST amorphous state, the CPW TL sees an open circuit for a length (L) of 2.5 mm. In the crystalline state, the GST becomes conductive and the TL doubles in length (L=5 mm). The resultant return loss of the circuit can be used to verify switching behavior since an impedance match occurs as the line length approaches a half wavelength (λ/2) and the input impedance ($Z_{in}$) becomes 50Ω. For the particular switch arrangement of FIG. 3A, the half wavelength condition occurs at ~19 GHz and the equivalent L=λ condition occurs at ~38 GHz demonstrating a wideband switch conductivity measurement.

Figure 3C:
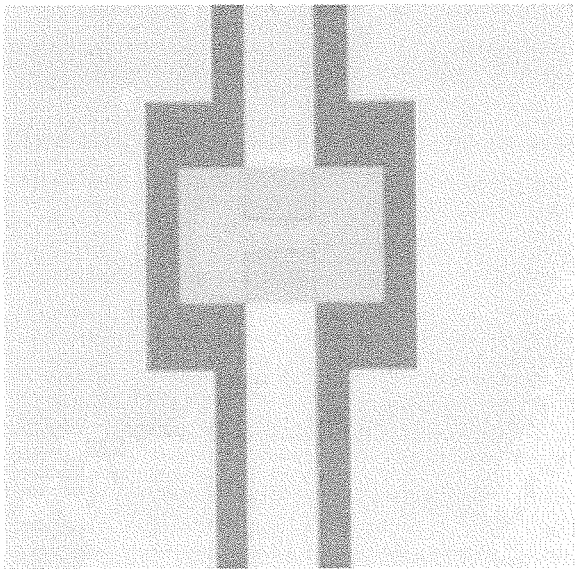
FIG. 3C is photograph of a switch manufactured according to the design of FIG. 3A illustrating the presence of ChG PCM as a switching material present across the gap between a first and a second radio frequency energy conductive element.
Figure 3D:
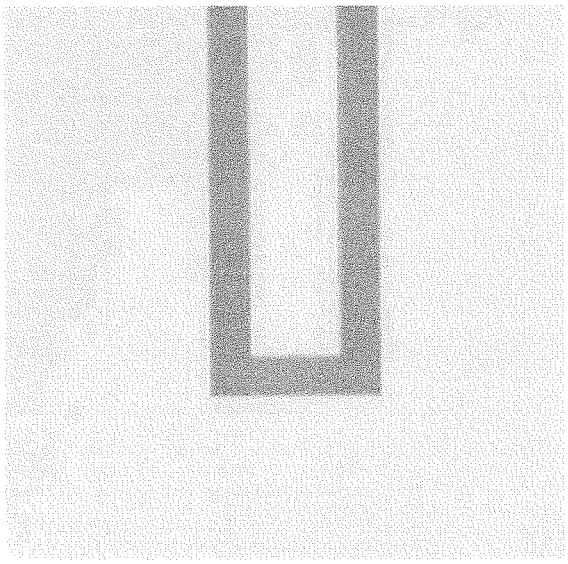
FIG. 3D is a photograph of the switch of FIG. 3C illustrating the test structure termination where probes were placed.
Figure 4A:
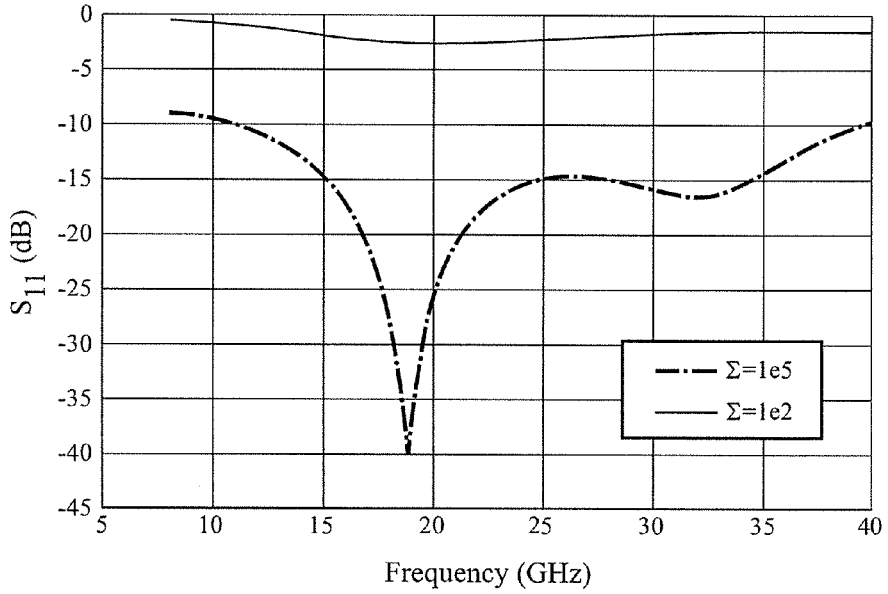
FIG. 4A illustrates simulated test structure data for varying ChG PCM material conductivities.
Figure 4B:
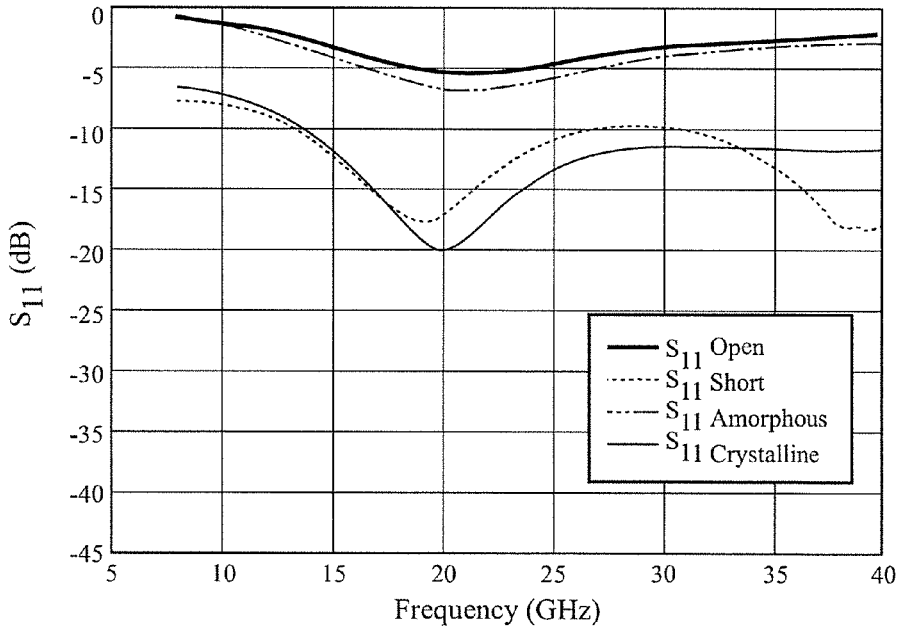
FIG. 4B illustrates measured test structure results using a switch manufactured according to the design of FIG. 3A and presented relative to two control cases.

To further estimate the material parameters, the measured reflection coefficients were compared to a series of models using the test structure of FIGS. 3C-3D where the GST material RF energy conductivity was varied within the simulation. The results from these simulations and measurements are shown in FIG. 4A & FIG. 4B, respectively. From these results, it is clear that there is a conductivity change of several orders of magnitude between the two phase states. When the GST was in the amorphous state, its response closely resembles a simulated response with a conductivity of approximately 100 S/m, or a resistivity of $1\times10^{-2}$ Ω-m. When the GST was in the crystalline state its response resembles a simulated response with a conductivity of approximately 100 kS/m, or a resistivity of $1\times10^{-5}$ Ω-m, a change of three orders of magnitude.

Figure 5:
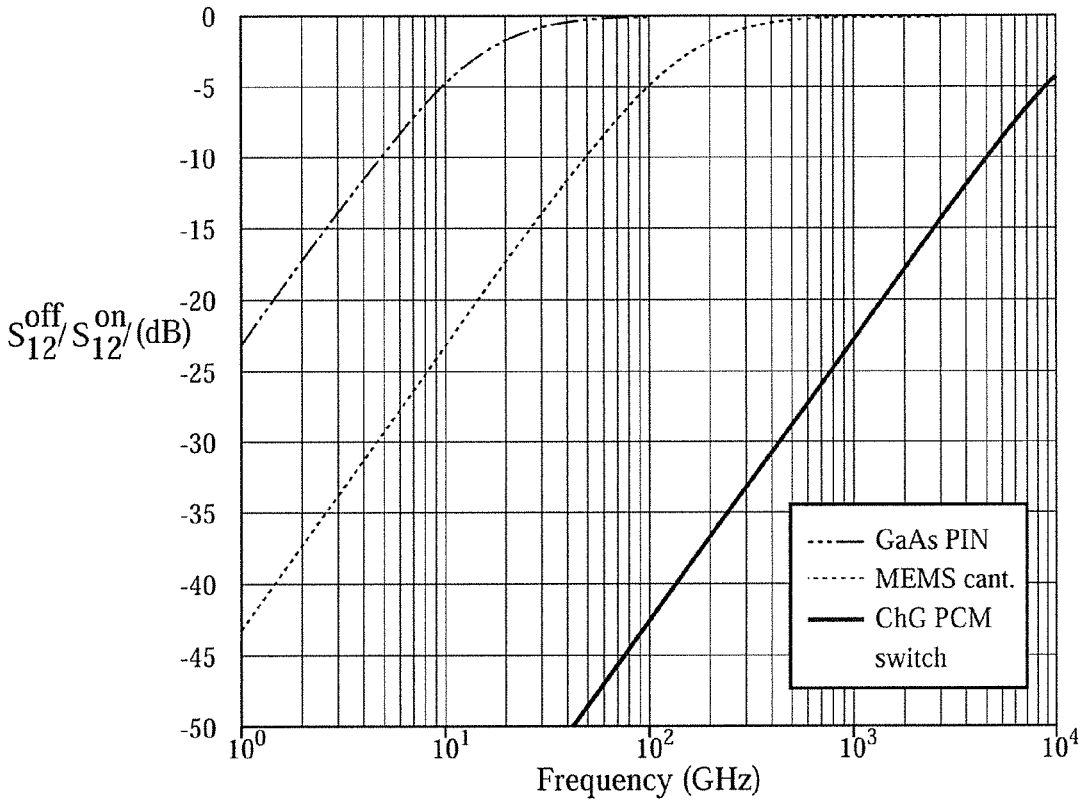
FIG. 5 illustrates switching ratio (db) for a GaAs pin diode, MEMS cantilever, and a ChG PCM material switch as a function of energy frequency.

The fact that the GST acts as a very good switch can further be seen by the comparison of the test structure response with the GST in both states to the control test structure responses, also shown in FIG. 4B. The "Open" control test structures were created by removing the GST material, leaving an opening in the center of the test structure, and the "Closed" control structure was created by depositing gold instead of GST at the center of the test structure. For the GST switch integrated into a 50Ω system, the calculated R and C values are 3.3 ohms and 0.5 fF respectively. As a result, the calculated insertion loss is −0.285 dB and dispersive on-off ratio is plotted in FIG. 5.

The switches and processes provided demonstrate that ChG PCMB function as a switch in the radio frequency spectrum. In some embodiments, the ChG PCM switch technology is used in applications beginning with (but not including) DC and continuing up to infrared frequencies. In some embodiments, the switches are configured to function in the RF spectrum only and not in other spectrums. Specifically, the bands that may be transmitted by the switches of the invention include: TLF, ELF, SLF, ULF, VLF, LF, MF, HF, VHF, UHF, SHF, EHF and THF bands. Compared to semiconductor and MEMS devices the provided ChG PCM based RF switches of the present invention are particularly advantageous due to the very large bandwidth, extremely large on/off ratio, excellent reliability, and low power consumption.

REFERENCE LIST

[1] G. M. Rebeiz, and J. B. Muldavin, "RF MEMS switches and switch circuits," IEEE Microwave Magazine, vol. 2, no. 4, pp. 59-71, December 2001.

[2] P. D. Grant, M. W. Denhoff, and R. R. Mansour, "A comparison between RF MEMS switches and semiconductor switches," Proceedings of the 2004 International Conference on MEMS, NANO and Smart Systems, ICMENS 2004, pp. 515-521, 25-27 Aug. 2004.

[3] R. Stefanini, M. Chatras, P. Blondy, and G. M. Rebeiz, "Miniature MEMS switches for RF applications," Journal of Microelectromechanical Systems, vol. 22, no. 6, pp. 1324-1335, December 2011.

[4] S. Hudgens, and B. Johnson, "Overview of phase-change chalcogenide nonvolatile memory technology," MRS Bulletin, vol. 29, pp. 829-832, 2004.

[5] H. S. Newman, J. L. Ebel, D. Judy, and J. Maciel, "Lifetime measurements on a high-reliability RFMEMS contact switch," IEEE Microwave and Wireless Components Letters, vol. 18, no. 2, pp. 100-102, February 2008.

[6] [Online]. Available: http://www.radantmems.com/radantmems/products.html

[7] Crunteanu Aurelian, Givernaud Julien, Blondy Pierre, Orlianges Jean-Christophe, Champeaux Corinne and Catherinot Alain (2010). Exploiting the Semiconductor-Metal Phase Transition of VO2 Materials: a Novel Direction towards Tuneable Devices and Systems for RF-Microwave Applications, Advanced Microwave and Millimeter Wave Technologies Semiconductor Devices Circuits and Systems, Moumita Mukherjee (Ed.), ISBN: 978-953-307-031-5, InTech, Available from: http://www.intechopen.com/books/advanced-microwave-andmillimeter-wave-technologies-semiconductor-devices-circuits-and-systems/exploiting-the-semiconductormetal-phase-transition-of-vo2-materials-a-novel-direction-towards-tunea

[8] Chua, E. K., et al., APPLIED PHYSICS LETTERS, 2010; 97, 183506

[9] Hummel G, Gharacterization of phase change materials for radiofrequency applications, 2012 NINN REU Research Accomplishments, pgs. 62-63; www.nnin.org/sites/default/files/ . . . /2012nninREU_Hummel.pdf

[10] U.S. Pat. No. 6,903,362

[11] U.S. Pat. No. 6,882,460

[12] U.S. Pat. No. 3,448,302

Various modifications of the present invention, in addition to those shown and described herein, will be apparent to those skilled in the art of the above description. Such modifications are also intended to fall within the scope of the appended claims.

It is appreciated that all materials or reagents are obtainable by sources known in the art unless otherwise specified.

Patents, publications, and applications mentioned in the specification are indicative of the levels of those skilled in the art to which the invention pertains. These patents, publications, and applications are incorporated herein by reference to the same extent as if each individual patent, publication, or application was specifically and individually incorporated herein by reference.

The foregoing description is illustrative of particular embodiments of the invention, but is not meant to be a limitation upon the practice thereof.

The invention claimed is:

1. A switch for use in circuits that conduct radio frequency electromagnetic energy comprising:

a substrate;

a first radio frequency energy conductive waveguide on said substrate;

a second radio frequency energy conductive waveguide on said substrate; and a switch element on said substrate, and electromagnetically connecting said first conductive waveguide to said second conductive waveguide, said switch element comprising a switching material; and an activation energy element operable for producing a heat pulse, said activation energy element imbedded into said switching material;

said switching material comprising $Ge_2Sb_2Te_5$ and switchable between a first radio frequency electromagnetic energy conductivity value and a second radio frequency electromagnetic energy conductivity value by application of said heat pulse to said switching material, such that said radio frequency electromagnetic energy flowing in said first conductive waveguide is either reflected off said switch element or transmitted through said switch element to said second conductive waveguide.

2. A switch for use in circuits that conduct radio frequency electromagnetic energy comprising:

a substrate;

a first radio frequency energy conductive element on said substrate;

a second radio frequency energy conductive element on said substrate;

a switch element on said substrate, and connecting said first conductive element to said second conductive element, said switch element comprising a switching material; and an activation energy element operable for producing a heat pulse, said activation energy element imbedded into said switching material;

said switching material comprising a chalcogenide compound switchable between a first radio frequency electromagnetic energy conductivity value and a second radio frequency electromagnetic energy conductivity value by application of said heat pulse to said switching material, such that said radio frequency electromagnetic energy flowing in said first conductive element is either reflected off said switch element or transmitted through said switch element to said second conductive element.

3. The switch of claim 2 wherein said switching material comprises Se, Te, or combinations thereof.

4. The switch of claim 2 wherein said switching material comprises Ge, Sb, Se, In, Ag, Sn, S, or combinations thereof.

5. The switch of claim 2 wherein said switching material comprises GeSbTe.

6. The switch of claim 2 wherein said switching material comprises $Ge_2Sb_2Te_5$.

7. The switch of claim 2 wherein said substrate comprises quartz, a polymeric material, or silicon.

8. The switch of claim 2 wherein said first radio frequency energy conductive element or said second radio frequency energy conductive element, or both, is a waveguide suitable for transmission of said radio frequency electromagnetic energy.

9. The switch of claim 2 wherein said second radio frequency electromagnetic energy conductivity value is higher than said first radio frequency electromagnetic energy conductivity value.

10. The switch of claim 2 wherein said radio frequency electromagnetic energy is in the band selected from the group consisting of TLF, ELF, SLF, ULF, VLF, LF, MF, HF, VHF, UHF, SHF, EHF, THF, and combinations thereof.

11. A process of regulating transmission of radio frequency electromagnetic energy through a switch comprising:

a substrate;

a first radio frequency energy conductive element on said substrate;

a second radio frequency energy conductive element on said substrate;

a switch element on said substrate, and connecting said first conductive element to said second conductive element, said switch element comprising a switching material; and an activation energy element operable for producing a heat pulse, said activation energy element imbedded into said switching material;

said switching material comprising a chalcogenide compound switchable between a first radio frequency electromagnetic energy conductivity value and a second radio frequency electromagnetic energy conductivity value by application of said heat pulse to said switching material, such that said radio frequency electromagnetic energy flowing in said first conductive element is either reflected off said switch element or transmitted through said switch element to said second conductive element;

applying said heat pulse to said switching material;

producing a phase change in said switching material from a first phase to a second phase imparted by said heat pulse;

said step of producing thereby altering the transmissibility of said switching material to said radio frequency electromagnetic energy from said first radio frequency electromagnetic energy conductivity value to said second radio frequency electromagnetic energy conductivity value.

12. The process of claim 11 wherein said switching material comprises $Ge_2Sb_2Te_5$.

13. The process of claim 11 wherein said second radio frequency electromagnetic energy conductivity value is higher than said first radio frequency electromagnetic energy conductivity value.

14. The process of claim 11 wherein said radio frequency electromagnetic energy is in the band selected from the group consisting of TLF, ELF, SLF, ULF, VLF, LF, MF, HF, VHF, UHF, SHF, EHF, THF, and combinations thereof.

15. The process of claim 11 wherein said step of applying is for a switching time of less than 100 microseconds.

16. The process of claim 11 wherein said switching material comprises Se, Te, or combinations thereof.

17. The process of claim 11 wherein said switching material comprises Ge, Sb, Se, In, Ag, Sn, S, or combinations thereof.

18. The process of claim 11 wherein said switching material comprises GeSbTe.

* * * * *